US011780706B2

(12) United States Patent
Wang et al.

(10) Patent No.: US 11,780,706 B2
(45) Date of Patent: Oct. 10, 2023

(54) MODULAR ELEVATOR ASSEMBLY AND RAIL

(71) Applicant: Otis Elevator Company, Farmington, CT (US)

(72) Inventors: Qirui Wang, Shanghai (CN); Bichun Li, Shanghai (CN); Shenhong Wang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/387,546

(22) Filed: Jul. 28, 2021

(65) Prior Publication Data

US 2022/0055862 A1 Feb. 24, 2022

(30) Foreign Application Priority Data

Aug. 24, 2020 (CN) ..... 202010856995.7

(51) Int. Cl.
*B66B 7/02* (2006.01)
*B66B 11/00* (2006.01)
(Continued)

(52) U.S. Cl.
CPC ..... *B66B 7/026* (2013.01); *B66B 11/0005* (2013.01); *B66B 11/043* (2013.01); *B66B 13/30* (2013.01)

(58) Field of Classification Search
CPC ..... B66B 11/0005; B66B 7/026; B66B 7/023; B66B 19/002; B66B 9/16; B66B 9/187; E04F 17/005
See application file for complete search history.

(56) References Cited

U.S. PATENT DOCUMENTS 4,231,148 A 11/1980 Harding

FOREIGN PATENT DOCUMENTS

CN 201494984 6/2010
CN 101941627 A 1/2011
(Continued)

OTHER PUBLICATIONS

Machine Translation of CN 208980130.*
European Search Report for Application No. 21192923.7; dated Jan. 13, 2022; 9 pages.

*Primary Examiner* — Diem M Tran
(74) *Attorney, Agent, or Firm* — CANTOR COLBURN LLP

(57) ABSTRACT

A modular elevator assembly and a guide rail. The modular elevator assembly includes: a bottom module; a top module; at least one intermediate module being configured to be removably stacked between the bottom module and the top module; and wherein each of the bottom module, the top module and the intermediate module includes a plurality of guide rails, and the cross section of the guide rail includes: a first section extending along a length direction of the guide rail; a second section extending in parallel to the first section and being attached to the first section; and a transition portion connecting between the first section and the second section and being configured to provide a cross-sectional profile that transits between the first section and the second section; and wherein the guide rail further includes a connection structure, the connection structure is configured to connect the guide rails.

14 Claims, 5 Drawing Sheets

(51) Int. Cl.
*B66B 11/04* (2006.01)
*B66B 13/30* (2006.01)

(56) References Cited

FOREIGN PATENT DOCUMENTS

| | | | | | |
|---|---|---|---|---|---|
| CN | 102180394 | A | | 9/2011 | |
| CN | 102249129 | A | | 11/2011 | |
| CN | 202072375 | U | | 12/2011 | |
| CN | 202098951 | U | | 1/2012 | |
| CN | 102583130 | A | | 7/2012 | |
| CN | 202321865 | U | | 7/2012 | |
| CN | 102649525 | A | | 8/2012 | |
| CN | 102745570 | A | | 10/2012 | |
| CN | 202988476 | U | | 6/2013 | |
| CN | 203545385 | U | | 4/2014 | |
| CN | 103803376 | A | | 5/2014 | |
| CN | 204661101 | U | | 9/2015 | |
| CN | 204661102 | U | | 9/2015 | |
| CN | 105173966 | A | | 12/2015 | |
| CN | 204917549 | U | | 12/2015 | |
| CN | 106458515 | A | | 2/2017 | |
| CN | 107180584 | A | | 9/2017 | |
| CN | 107416649 | A | | 12/2017 | |
| CN | 107963533 | A | | 4/2018 | |
| CN | 108698794 | A | | 10/2018 | |
| CN | 108946383 | A | | 12/2018 | |
| CN | 109132815 | A | | 1/2019 | |
| CN | 208531965 | U | | 2/2019 | |
| CN | 109399420 | A | | 3/2019 | |
| CN | 208980130 | U | * | 6/2019 | |
| CN | 110027962 | A | | 7/2019 | |
| CN | 110077933 | A | | 8/2019 | |
| CN | 209226353 | U | | 8/2019 | |
| CN | 209957181 | U | | 1/2020 | |
| CN | 111232808 | A | | 6/2020 | |
| CN | 210795438 | U | | 6/2020 | |
| CN | 211004062 | U | | 7/2020 | |
| CN | 1248948 | C | | 9/2020 | |
| EP | 0381852 | A1 | | 8/1990 | |
| EP | 3747820 | A1 | * | 12/2020 | ..... B66B 11/0005 |
| JP | H0275586 | A | | 3/1990 | |
| JP | H10203747 | A | | 8/1998 | |
| JP | 2006290488 | A | | 10/2006 | |
| WO | 2014013453 | A2 | | 1/2014 | |
| WO | 2018163297 | A1 | | 9/2018 | |

* cited by examiner

MODULAR ELEVATOR ASSEMBLY AND RAIL

FOREIGN PRIORITY

This application claims priority to Chinese Patent Application No. 202010856995.7, filed Aug. 24, 2020, and all the benefits accruing therefrom under 35 U.S.C. § 119, the contents of which in its entirety are herein incorporated by reference.

TECHNICAL FIELD

The present application relates to the field of elevator structures. More specifically, the present application relates to a modular elevator assembly, which aims to provide convenient and flexible on-site assembling of an elevator. The present application also relates to a guide rail for the modular elevator assembly.

BACKGROUND

Existing elevator components are usually manufactured separately and assembled at an installation site in a building. For example, components such as an elevator frame, a guide rail, a landing door, a tractor and the like may be manufactured separately and welded or connected together within a hoistway at the installation site.

Such a structure increases the workload of on-site operations, and it may be difficult to accurately install and position various components due to the complexity of the on-site conditions.

CN102180394B discloses a building block type elevator, which includes a modular steel structural hoistway. The modular steel structural hoistway includes a bottom frame, an intermediate frame and a top frame from bottom to top. The steel structural hoistway is provided with side-opened hall doors.

CN107963533A discloses a method for designing a modular elevator hoistway, in which the elevator hoistway structure is divided into sections according to different floor positions, including a H1-section member at the pit, a H2-section member at the top, and several H2-section members provided between the H1-section member and the H2-section member. Beams, floor columns, landing door head beams and landing door columns of various sections are spliced respectively, and then hoisted and connected in sequence.

SUMMARY

The object of an aspect of the present application is to provide a modular elevator assembly, which aims to provide a modular elevator construction solution. The object of another aspect of the present application is to provide a guide rail for the modular elevator assembly.

The objects of the present application are achieved through the following technical solutions.

A modular elevator assembly is provided, which includes: a bottom module; a top module; at least one intermediate module being configured to be removably stacked between the bottom module and the top module; and wherein each of the bottom module, the top module and the intermediate module includes a plurality of guide rails, and a cross section of the guide rail includes: a first section extending along a length direction of the guide rail; a second section extending in parallel to the first section and being attached to the first section; and a transition portion connecting between the first section and the second section and being configured to provide a cross-sectional profile that transits between the first section and the second section; and wherein the guide rail further includes a connection structure, the connection structure is configured to connect the guide rails within adjacent modules in the modular elevator assembly together.

In the above modular elevator assembly, optionally, the connection structure includes a protrusion or a recess formed at an end face in the length direction of the guide rail, and the protrusion and the recess are configured to match with each other in shape.

In the above modular elevator assembly, optionally, the protrusion includes a conical first protrusion and a sawtooth-shaped second protrusion, and the recess includes a conical first recess and a sawtooth-shaped second recess.

In the above modular elevator assembly, optionally, the first protrusion and the first recess are disposed at the transition portions at the end faces of the guide rails, and the second protrusion and the second recess are disposed at the first sections or the second sections at the end faces of the guide rails.

In the above modular elevator assembly, optionally, the bottom module, the top module and the intermediate module respectively includes a frame, the frame includes a first side face, a second side face, a third side face and a fourth side face, and the guide rails are attached to the frame through connection members and are oriented such that the length direction is in the vertical direction, wherein the guide rails and the frames have matching dimensions in the vertical direction.

In the above modular elevator assembly, optionally, the guide rails includes first guide rails for matching with an elevator car and second guide rails for matching with a counterweight.

In the above modular elevator assembly, optionally, the first guide rails are disposed at the second side face and the fourth side face, and the second side face and the fourth side face are positioned to face each other; the second guide rails are disposed at the third side face, and the third side face is positioned between the second side face and the fourth side face.

In the above modular elevator assembly, optionally, further comprising a landing door the landing door is attached to the first side face of the frame.

In the above modular elevator assembly, optionally, the position of the landing door relative to the frame is movable.

In the above modular elevator assembly, optionally, a plurality of installation portions for fixing the frames into the hoistway are disposed on the peripheries of the frames of the top module and the intermediate module.

In the above modular elevator assembly, optionally, the frame of each module are connected by connection structures and bolts and are stacked together.

In the above modular elevator assembly, optionally, the bottom of the bottom module is provided with a bottom panel, and the bottom module includes one or more of the following components: a speed limiter, a tensioner, a compensation rope, a guide device, a lighting system, a power supply system, an intercom system, and a maintenance entrance.

In the above modular elevator assembly, optionally, a plurality of plates are provided at the bottom of the bottom module, and the plates are disposed below the bottom panel.

In the above modular elevator assembly, optionally, a top panel is provided at the top of the top module, and the top module includes one or more of the following components: a tractor, a sling, and a motor.

In the above modular elevator assembly, optionally, the frame is configured to be hollow, and cables extend through each of the frames and are fixed relative to the frames, wherein both ends of the cables are respectively provided with sockets.

In the above modular elevator assembly, optionally, the bottom module, the top module and the intermediate module include a plurality of lifting rings respectively, and the lifting rings are arranged toward the top of each module.

A guide rail for installing in a module of a modular elevator assembly, wherein the cross section of the guide rail includes: a first section extending along a length direction of the guide rail; a second section extending in parallel to the first section and being attached to the first section; and a transition portion connecting between the first section and the second section and being configured to provide a cross-sectional profile that transits between the first section and the second section; and wherein the guide rail further includes a connection structure, the connection structure is configured to connect the guide rails within adjacent modules in the modular elevator assembly together.

In the above guide rail, optionally, the connection structure includes a protrusion or a recess formed at an end face in the length direction of the guide rail, and the protrusion and the recess are configured to match with each other in shape.

In the above guide rail, optionally, the protrusion includes a conical first protrusion and a sawtooth-shaped second protrusion, and the recess includes a conical first recess and a sawtooth-shaped second recess.

In the above guide rail, optionally, the first protrusion and the first recess are disposed at the transition portions at the end faces of the guide rails, and the second protrusion and the second recess are disposed at the first sections or the second sections at the end faces of the guide rails.

BRIEF DESCRIPTION OF THE DRAWINGS

The present application will be described below in further detail with reference to the accompanying drawings and preferred embodiments. Those skilled in the art will appreciate that these drawings are drawn only for the purpose of explaining the preferred embodiments, and therefore should not be construed as limiting the scope of the present application. In addition, unless specifically stated, the drawings are only intended to conceptually represent the composition or construction of the described objects, and may contain exaggerated illustration. The drawings are not necessarily drawn to scale.

DETAILED DESCRIPTION

Figure 1:
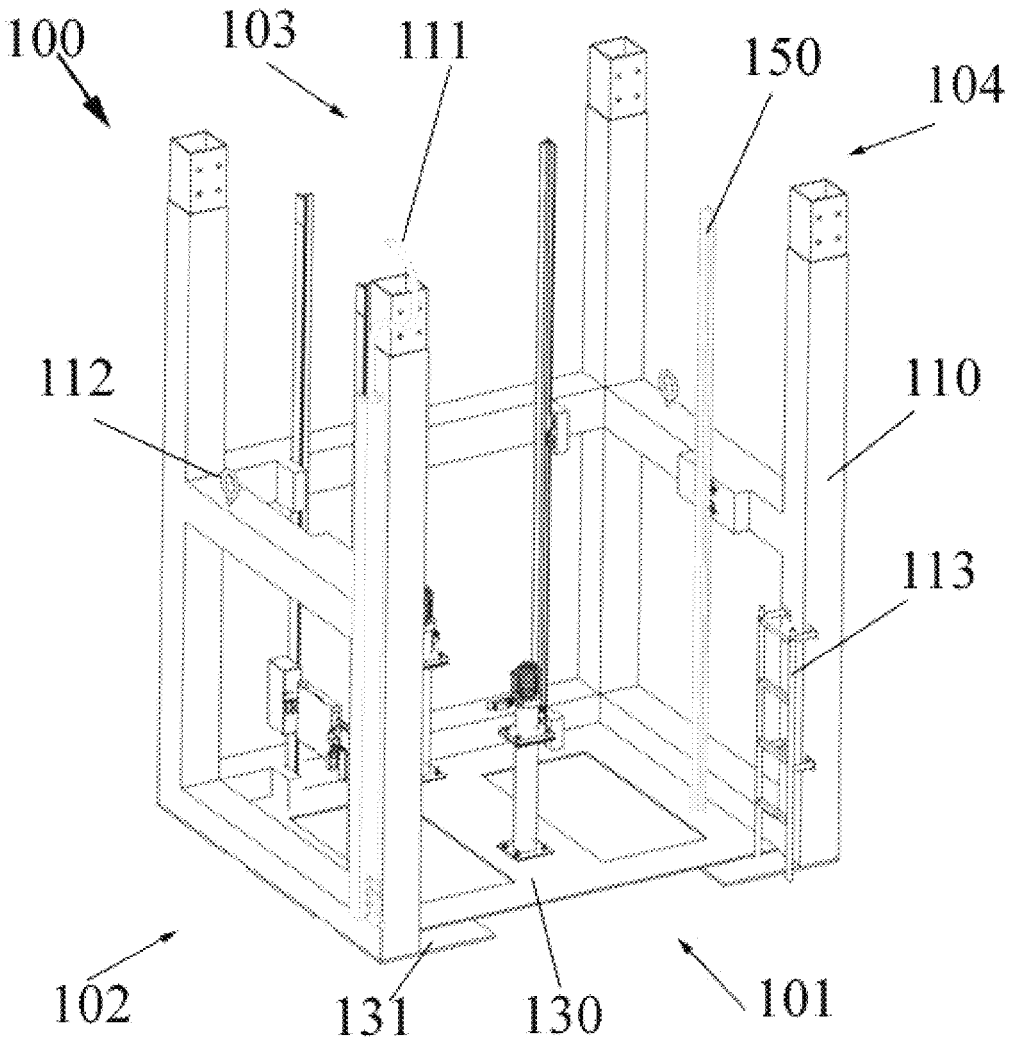
FIG. 1 is a perspective view of a bottom module according to one embodiment of the present application.

Hereinafter, preferred embodiments of the present application will be described in detail with reference to the accompanying drawings. Those skilled in the art will appreciate that these descriptions are merely illustrative and exemplary, and should not be construed as limiting the scope of protection of the present application.

Firstly, it should be noted that the orientational terms such as top, bottom, upward, downward and so on mentioned herein are defined with respect to the directions in various drawings. These orientations are relative concept, and therefore will vary with the position and state thereof. Accordingly, these or other orientational terms should not be interpreted as restrictive.

In addition, it should also be noted that for any single technical feature described or implied in the embodiments herein, or any single technical feature shown or implied in the drawings, it is still possible to combine these technical features (or their equivalents), so as to obtain other embodiments that are not directly mentioned herein.

It should be noted that in different drawings, identical or substantially identical components are denoted by identical reference numbers.

The vertical direction mentioned herein refers to the direction of gravity. The horizontal direction mentioned herein refers to the direction indicated by the straight lines in a plane in which the horizontal plane is located.

One embodiment of the present application provides a modular elevator assembly, which includes a bottom module 100, a top module 200, and at least one intermediate module 300. During on-site installation, the bottom module 100 is installed at the bottom of an elevator hoistway, so it is also called as a pit module. The top module 200 is installed at the top of the elevator hoistway, and one or more intermediate modules 300 are removably stacked or superimposed between the bottom module 100 and the top module 200. For example, the bottom module 100, the top module 200 and the plurality of intermediate modules 300 may be manufactured at the manufacturing site respectively, then transported to the installation site, and sequentially hoisted from the bottom. Each module may be sized to correspond to the floor. For example, the intermediate module may have a size corresponding to a single floor of the building, the top module may have a size corresponding to the top elevator room of the building, and the bottom module may have a size corresponding to the bottom elevator room of the building.

FIG. 1 is a perspective view of a bottom module according to one embodiment of the present application. The bottom module 100 may include a frame 110. The frame 110 may be configured into a substantially cubic shape, so as to define a space therein for accommodating the car. The frame 110 may include a plurality of vertical structural members in a vertical direction and a plurality of horizontal structural members in a horizontal direction, and the horizontal structural members may be attached between the vertical structural members so as to define each side face of the cubic shape. In one embodiment, each of the above structural members may be a steel structural member. In the illustrated embodiment, a first side face 101, a second side face 102, a third side face 103 and a fourth side face 104 are defined on the periphery of the frame 110.

Various elevator components may be installed inside the frame 110. For example, in the illustrated bottom module 100, the bottom of the frame 110 is equipped with a bottom panel 130, and includes one or more of the following components: a speed limiter, a tensioner, a compensation rope, a guide device, a lighting system, a power supply system, an intercom system, a maintenance entrance and any other suitable components. For example, at least some of the aforementioned components may be installed on the bottom panel 130. FIG. 1 schematically shows ladder 113 being arranged in the bottom module 100.

Upper and lower ends of the vertical structural member of the frame 110 may be provided with a sleeve structure and an installation hole, so as to match with and connect to the frames of other modules. In some embodiments, the vertical structural member of the frame 110 may be configured to be hollow, and cables may extend along the inside or outside of the vertical structural member. Ends of the cable may have terminals, so as to connect with the cables in other modules. The cables may include one or more of the following: a power cable, a control cable, a data cable, a communication cable, etc.

The bottom module 100 may include a plurality of guide rails 150, and the guide rails 150 may extend along a length direction and are oriented such that the length direction is substantially parallel to the vertical direction or the direction of gravity. The guide rails 150 may be fixed to the horizontal structural members of the frame 110, and the specific fixing direction thereof will be described in detail below. The size of each guide rail 150 in the length direction may be configured to be substantially identical with the size of the frame 110 in the vertical direction. For example, as shown in the figure, a lower end of the guide rail 150 may be positioned at the bottom panel 130, and an upper end of the guide rail 150 may be positioned at approximately the same height as the top of the frame 110. In addition, as will be described in more detail below, the upper end of the guide rail 150 may have a connection structure for attaching to the guide rail in the intermediate module. The connection structure connects the guide rails in adjacent modules in the modular elevator assembly together.

More specifically, the guide rails 150 may be divided into first guide rails for matching with an elevator car (not shown) and second guide rails for matching with a counterweight (not shown). The first guide rails may be disposed at the second side face 102 and the fourth side face 104 of the frame 110, so as to be respectively located at both sides of the elevator car (not shown). In addition, the second side face 102 may be disposed opposite to the fourth side face 104. The second guide rails may be disposed at the third side face 103. In addition, the third side face 103 may be disposed between the second side face 102 and the fourth side face 104, and the first side face 101 may be disposed opposite to the third side face 103.

Although not shown, in some embodiments, a landing door may be installed at the first side face 101. In some other embodiments, there is no landing door installed at the first side face 101.

A plurality of plates 131 may be provided at the bottom of the bottom module 100. These plates 131 may be arranged along the periphery of the frame 110 and below the bottom panel 130. The plates 131 serve to distribute the weight and reduce the pressure of the modular elevator assembly on the bottom of the hoistway.

A plurality of lifting rings 112 may be provided on the bottom module 100. For example, in the illustrated embodiment, a plurality of lifting rings 112 are substantially evenly distributed on the horizontal structural members of the frame 110 and are positioned toward the top of the bottom module 100 or accessible from the top of the bottom module 100. When the bottom module 100 needs to be installed, the bottom module 100 may be suspended by means of the hoist rings 112 and raised/lowered, so as to move to a desired position in the hoistway.

Figure 2:
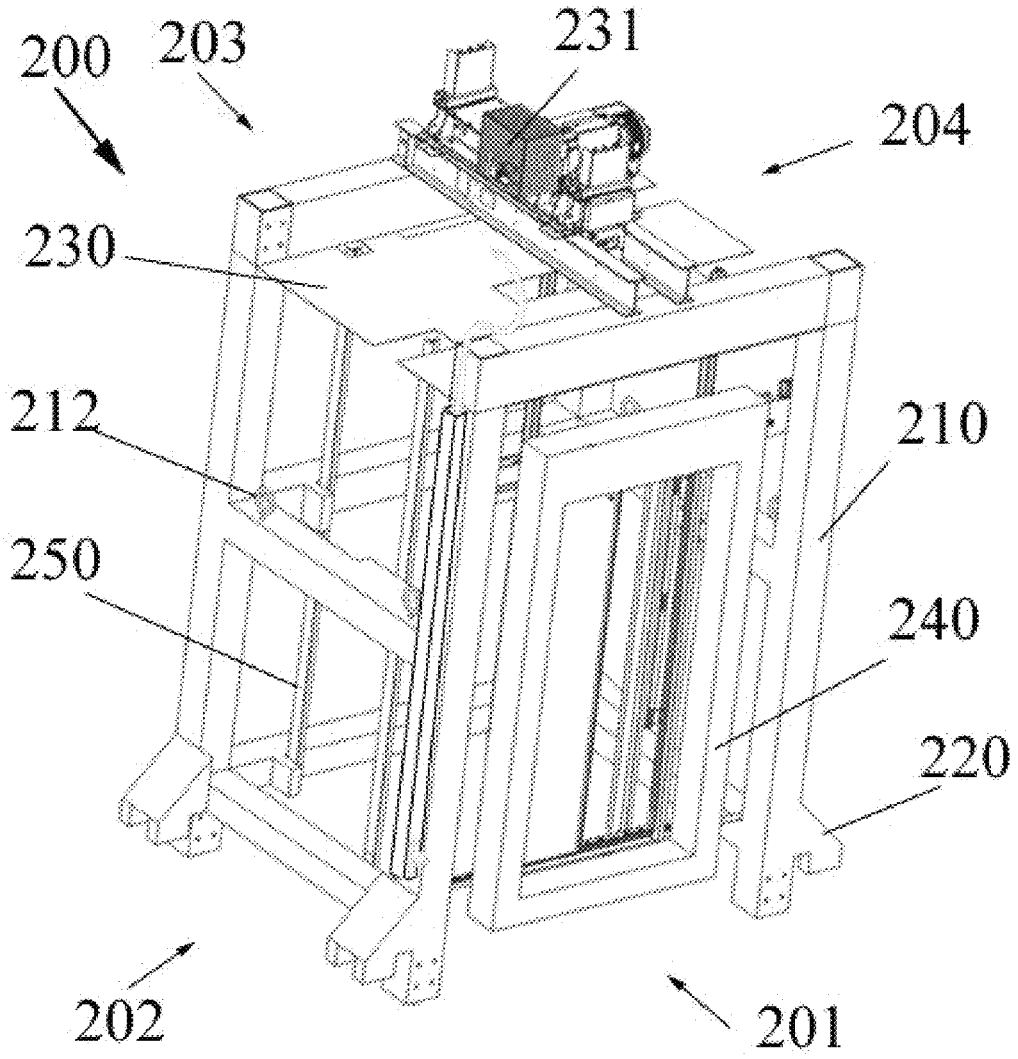
FIG. 2 is a perspective view of a top module according to one embodiment of the present application.

FIG. 2 is a perspective view of a top module according to one embodiment of the present application. The top module 200 may include a frame 210. The frame 210 may be configured into a substantially cubic shape, so as to define a space for accommodating the car inside. A plurality of installation portions 220 may be provided on the periphery of the frame 210, and each installation portion 220 is sized to correspond to an installation hole in the elevator hoistway (not shown). The frame 210 may include a plurality of vertical structural members in the vertical direction and a plurality of horizontal structural members in the horizontal direction, and the horizontal structural members may be attached between the vertical structural members so as to define each side face of the cubic shape. In one embodiment, each of the above structural members may be a steel structural member. In the illustrated embodiment, a first side face 201, a second side face 202, a third side face 203 and a fourth side face 204 are defined on the periphery of the frame 210.

Various elevator components may be installed inside the frame 210. For example, in the illustrated top module 200, the top of the frame 210 is equipped with a top panel 230, and includes one or more of the following components: a tractor, a sling, a motor and any other suitable components. For example, at least some of the aforementioned components may be installed on the top panel 230. FIG. 2 schematically shows that a motor 231 is installed at the top of the frame 210.

Upper and lower ends of the vertical structural member of the frame 210 may be provided with a sleeve structure and an installation hole, so as to match with and connect to the frames of other modules. In some embodiments, the vertical structural member of the frame 210 may be configured to be hollow, and cables may extend along the inside or outside of the vertical structural member. Ends of the cables may have terminals, so as to connect with cables in other modules. The cables may include one or more of the following: a power cable, a control cable, a data cable, a communication cable, etc.

The top module 200 may include a plurality of guide rails 250, and the guide rails 250 may extend along a length direction and are oriented such that the length direction is substantially parallel to the vertical direction or the direction of gravity. The guide rails 250 may be fixed to the horizontal structural members of the frame 210, and the specific fixing direction thereof will be described in detail below. The size of each guide rail 250 in the length direction may be configured to be substantially identical with the size of the frame 210 in the vertical direction. For example, as shown in the figure, an upper end of the guide rail 250 may be positioned at the top panel 230, and a lower end of the guide rail 250 may be positioned at approximately the same height as the bottom of the frame 210. In addition, as will be described in more detail below, the lower end of the guide rail 250 may have a connection structure for attaching to the guide rail in the intermediate module. The connection structure connects the guide rails in adjacent modules in the modular elevator assembly together.

More specifically, the guide rails 250 may be divided into first guide rails for matching with the elevator car (not shown) and second guide rails for matching with the counterweight (not shown). The first guide rails may be disposed at the second side face 202 and the fourth side face 204 of the frame 210, so as to be respectively located at both sides of the elevator car (not shown). In addition, the second side face 202 may be disposed opposite to the fourth side face 204. The second guide rail may be disposed at the third side face 203. In addition, the third side face 203 may be disposed between the second side face 202 and the fourth side face 204, and the first side face 201 may be disposed opposite to the third side face 203.

A landing door 240 may be installed at the first side face 201 of the frame 210. The landing door 240 is fixed relative to the frame 210, and the fixed position is adjustable. For example, the landing door 240 may be connected to the frame 210 by a connection member having a plurality of long-waisted holes. By installing bolts at different positions of the long-waisted holes, the fixed position of the landing door 240 relative to the frame 210 can be adjusted.

The long-waisted hole as mentioned herein refers to a hole having rounded ends and a rectangular intermediate portion connected between the ends. The ends may have diameter matching with the bolts, and the intermediate portion may have a height matching with the bolts. The long-waisted holes may be arranged to form a predetermined angle with respect to the horizontal plane, and the long-waisted holes may be arranged to be parallel to each other or form a predetermined angle.

A plurality of lifting rings 212 may be provided on the top module 200. For example, in the illustrated embodiment, a plurality of lifting rings 212 are substantially evenly distributed on the horizontal structural members of the frame 210 and are positioned toward the top of the top module 200 or accessible from the top of the top module 200. When the top module 200 needs to be installed, the top module 200 may be suspended by means of the hoist rings 212 and raised/lowered, so as to move to a desired position in the hoistway. For example, the top module 200 may be stacked over the intermediate module 300.

Figure 3:
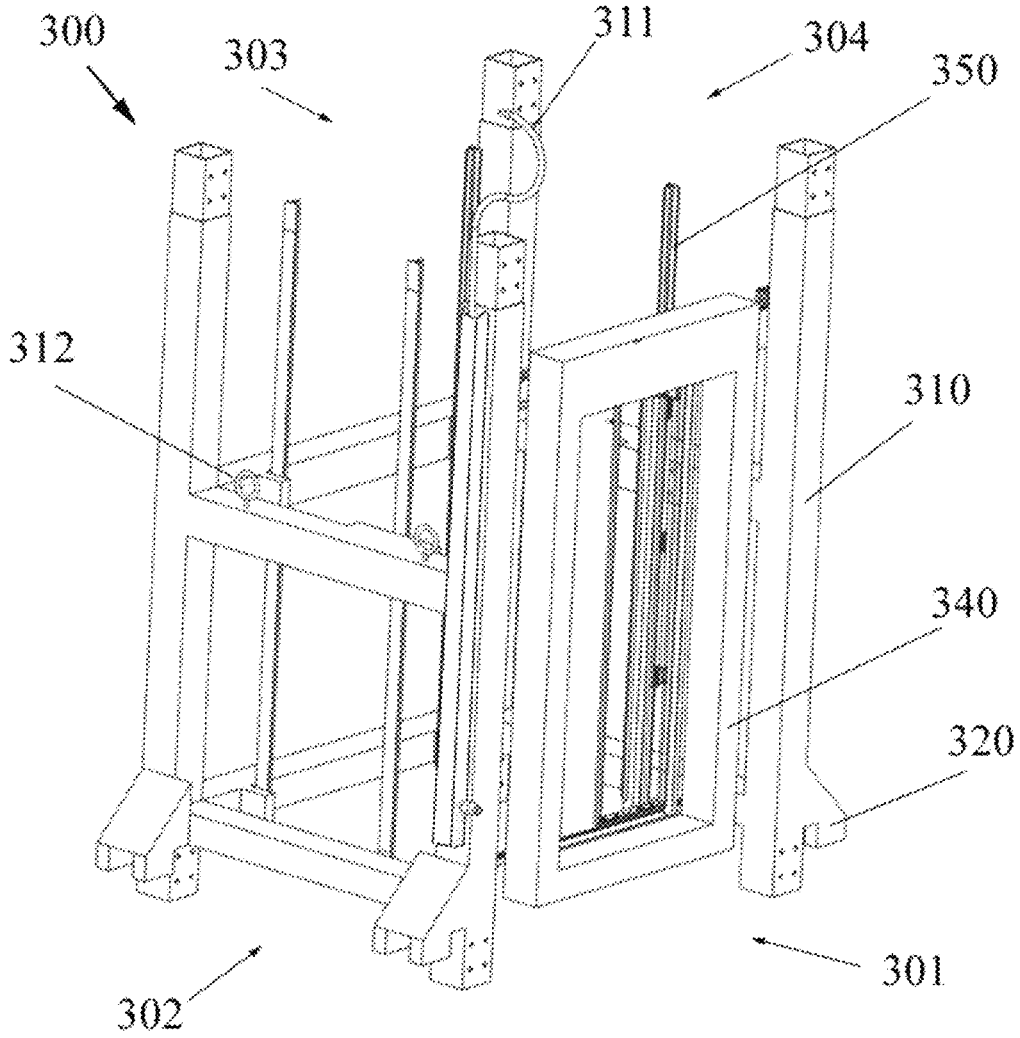
FIG. 3 is a perspective view of an intermediate module according to one embodiment of the present application.

FIG. 3 is a perspective view of an intermediate module according to one embodiment of the present application. The intermediate module 300 may include a frame 310. The frame 310 may be configured into a substantially cubic shape, so as to define a space for accommodating the car inside. A plurality of installation portions 320 may be provided on the periphery of the frame 310, and each installation portion 320 is sized to correspond to an installation hole in the elevator hoistway (not shown). The frame 310 may include a plurality of vertical structural members in the vertical direction and a plurality of horizontal structural members in the horizontal direction, and the horizontal structural members may be attached between the vertical structural members, so as to define each side face of the cubic shape. In one embodiment, each of the above structural members may be a steel structural member. In the illustrated embodiment, a first side face 301, a second side face 302, a third side face 303 and a fourth side face 304 are defined on the periphery of the frame 310.

Various elevator components may be installed inside the frame 310. For example, the frame 310 may accommodate an elevator car and a counterweight (not shown).

Upper and lower ends of the vertical structural member of the frame 310 may be provided with a sleeve structure and an installation hole, so as to match with and connect to the frames of other modules. In some embodiments, the vertical structural member of the frame 310 may be configured to be hollow, and cables may extend along the inside or outside of the vertical structural member. Ends of the cables may have terminals, so as to connect with cables in other modules. The cables may include one or more of the following: a power cable, a control cable, a data cable, a communication cable, etc.

The top module 300 may include a plurality of guide rails 350, and the guide rails 350 may extend along a length direction and are oriented such that the length direction is substantially parallel to the vertical direction or the direction of gravity. The guide rails 350 may be fixed to the horizontal structural members of the frame 310, and the specific fixing direction thereof will be described in detail below. The size of each guide rail 350 in the length direction may be configured to be substantially identical with the size of the frame 310 in the vertical direction. For example, as shown in the figure, an upper end of the guide rail 350 may be positioned at an intermediate panel 330, and a lower end of the guide rail 350 may be positioned at approximately the same height as the bottom of the frame 310. In addition, as will be described in more detail below, the lower end of the guide rail 350 may have a connection structure for attaching to the upper end of the guide rail 350 of another intermediate module 300 or the upper end of the guide rail 150 of the bottom module 100. The upper end of the guide rail 350 may have a connection structure for attaching to the lower end of the guide rail 350 of another intermediate module 300 or the lower end of the guide rail 250 of the top module 200. The connection structures connect the guide rails in adjacent modules in the modular elevator assembly together.

More specifically, the guide rails 350 may be divided into first guide rails for matching with the elevator car (not shown) and second guide rails for matching with the counterweight (not shown). The first guide rails may be disposed at the second side face 302 and the fourth side face 304 of the frame 310, so as to be respectively located at both sides of the elevator car (not shown). In addition, the second side face 302 may be disposed opposite to the fourth side face 304. The second guide rail may be disposed at the third side face 303. In addition, the third side face 303 may be disposed between the second side face 302 and the fourth side face 304, and the first side face 301 may be disposed opposite to the third side face 303.

A landing door 340 may be installed at the first side face 301 of the frame 310. The landing door 340 is fixed relative to the frame 310, and the fixed position is adjustable. For example, the landing door 340 may be connected to the frame 310 by a connection member having a plurality of long-waisted holes. By installing bolts at different positions of the long-waisted holes, the fixed position of the landing door 340 relative to the frame 310 can be adjusted.

A plurality of lifting rings 312 may be provided on the intermediate module 300. For example, in the illustrated embodiment, a plurality of lifting rings 312 are substantially evenly distributed on the horizontal structural members of the frame 310 and are positioned toward the top of the intermediate module 300 or accessible from the top of the intermediate module 300. When the intermediate module 300 needs to be installed, the intermediate module 300 may be suspended by means of the hoist rings 312 and raised/lowered to move to a desired position in the hoistway. For example, the intermediate module 300 may be stacked over another intermediate module 300 or over the bottom module 100.

The frames shown and described in FIGS. 1 to 3 may be configured to be substantially identical, and the guide rails may also be configured to be substantially identical, or some modifications can be made according to actual needs. In addition, the landing door of the top module 200 in FIG. 2 may be configured to be substantially identical with the landing door of the intermediate module 300 in FIG. 3, or some modifications may also be made according to actual needs.

Figure 4:
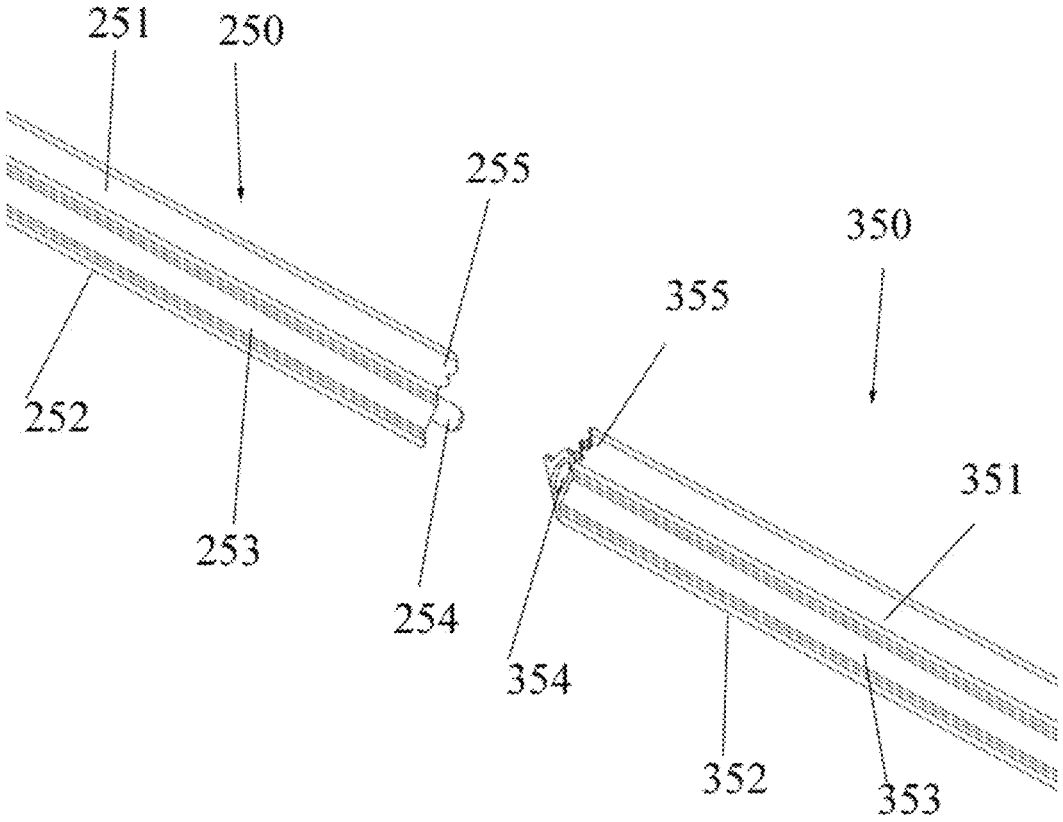
FIG. 4 is a perspective schematic view of guide rails according to one embodiment of the present application before assembling.
Figure 5:
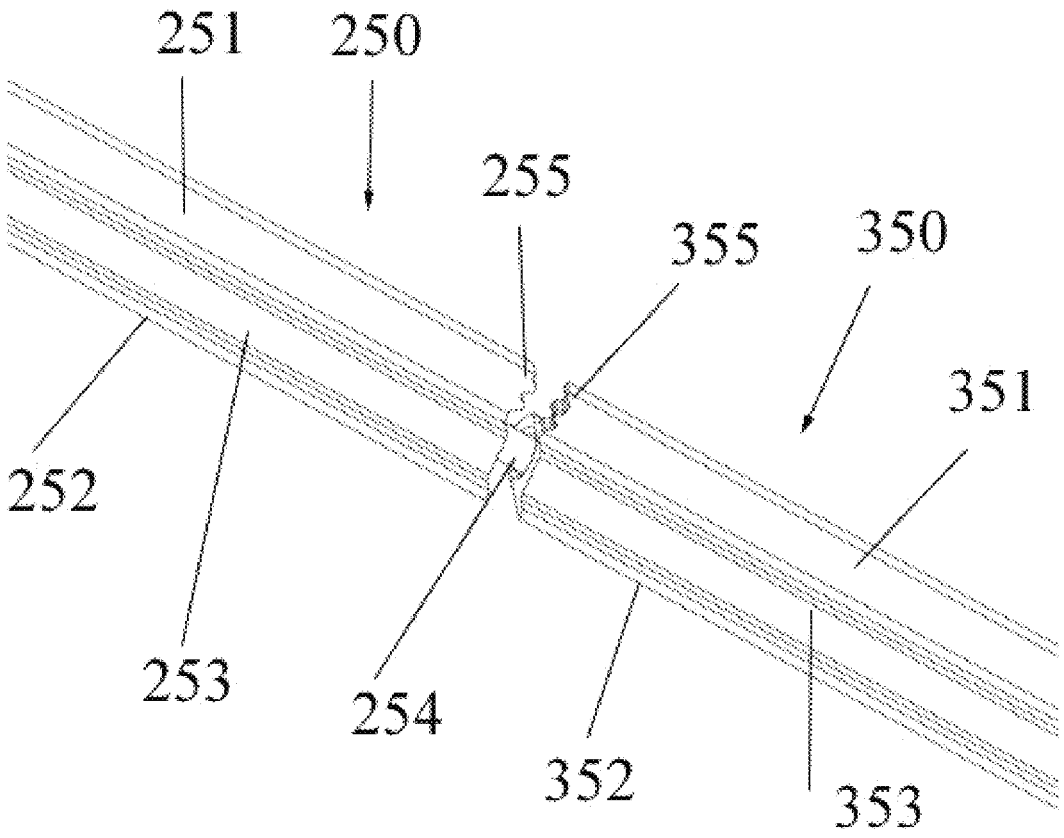
FIG. 5 is a perspective schematic view of guide rails according to one embodiment of the present application during assembling.

FIG. 4 is a schematic perspective view of guide rails according to one embodiment of the present application before assembling, and FIG. 5 is a schematic perspective view of guide rails according to one embodiment of the present application during assembling. For the sake of clarity, the two guide rails in FIGS. 4 and 5 are shown as being disposed in substantially horizontal direction. It is easy to understand that in the actual modular elevator assembly, the guide rails are actually disposed in a substantially vertical direction. In addition, the extension length of each rail in the length direction or the vertical direction may be substantially equal to the size of each frame in the vertical direction.

In FIGS. 4 and 5, the connection of the guide rail 250 of the top module 200 and the guide rail 350 of the intermediate module 300 is taken as an example to illustrate the structure and connection of the guide rails. It is easy to understand that the guide rails 350 in different intermediate modules 300 may also be constructed and connected in a similar manner, and the guide rails 350 in the intermediate module 300 may also be constructed and connected in a similar manner to the guide rails 150 in the bottom module 100.

It is easy to understand that the ends of the guide rails in each module are respectively positioned to align with each other when the adjacent modules are attached together, so that the guide rails in the modules can be connected together in the following manner, thereby forming a longer guide rail extending through the entire height direction of the modular elevator assembly.

Hereinafter, the guide rail 250 in FIGS. 4 and 5 will be taken as an example to illustrate half of the structure of the guide rail. As shown in the figures, the guide rail 250 includes: a first section 251 extending along the length direction of the guide rail 250; a second section 252 extending in parallel to the first section 251 and being attached to the first section 251; and a transition portion 253 connecting between the first section 251 and the second section 252 and being configured to provide a cross-sectional profile that transits between the first section 251 and the second section 252. The transition portion 253 may be configured to have a substantially circular cross-section, and may also be configured to provide a smooth rounded transition between the first section 251 and the second section 252. The first section 251 and the second section 252 may be positioned substantially perpendicular to each other, and one end of the first section 251 is positioned towards a perpendicular center line of the second section 252, so that the first section 251 and the second section 252 form an end portion with a T-shaped cross section. The transition portion 253 provides a thickened size portion for the guide rail, that is, the guide rail 250 has a thicker or larger cross section dimension at the transition portion 253 than the outward ends of the first section 251 and the second section 252, which improves the structural strength of the guide rail 250.

Similarly, the guide rail 350 also includes a first section 351, a second section 352 and a transition portion 353, and has the various configurations described above.

A connection structure is provided at end faces of the perpendicularly adjacent guide rail 250 and guide rail 350, respectively. For example, the guide rail 250 includes a first protrusion 254 extending at the transition portion 253 at the end of the guide rail 250. The first protrusion 254 may be configured to extend along the length direction of the guide rail 250. Correspondingly, the guide rail 350 includes a first recess 354 formed in the transition portion 353 at the end of the guide rail 350, and the first recess 354 may be configured to extend along the length direction of the guide rail 350. The first recess 354 may be configured to match with the first protrusion 254 in shape and size. In addition, the guide rail 250 includes a second protrusion 255 extending at the first section 251 at the end of the guide rail 250, and the guide rail 350 is correspondingly provided with a second recess 355 at the first section 351. The second protrusion 255 and the second recess 355 match in shape and size. In another embodiment, the second section 252 of the guide rail 250 and the second section 352 of the guide rail 350 are respectively provided with a protrusion and a recess. In yet another embodiment, the first section 251 and the second section 252 of the guide rail 250 and the first section 351 and the second section 352 of the guide rail 350 are each provided with a protrusion and a recess.

In the illustrated embodiment, the connection structures on the guide rails 250 are all protrusions, and the connection structures on the guide rails 350 are all recesses. In another embodiment, the connection structures on the guide rails 250 may be recesses, and the connection structures on the guide rails 350 may be protrusions. In yet another embodiment, the connection structures on the guide rails 250 may include both a recess and a protrusion, and the connection structures on the guide rails 350 may include both a recess and a protrusion.

In the illustrated embodiment, the protrusion 254 is configured to have a circular cross section along the length direction, and may be configured to be substantially cylindrical. In another embodiment, the cross section gradually tapers from the side close to the end of the guide rail 250 to the side away from the end of the guide rail 250, thereby forming a substantially conical or bullet-shaped profile. However, the present application is not limited to the illustrated shape of the protrusion, and the protrusion may have a cross section of other shapes or a cross section having different shapes along the length direction.

The configurations of the guide rails in various modules may be identical; for example, the guide rails in all the modules may each have a recess at the upper end of the guide rail and a protrusion at the lower end of the guide rail, or each have a protrusion at the upper end of the guide rail and a recess at the lower end of the guide rail. In some embodiments, the guide rails in some modules may have a protrusion at both the upper and lower ends, or have a recess at both the upper and lower ends. The guide rails in the same module may have upper and lower ends with identical configuration, or may have upper end and/or lower end with different configuration. According to actual needs, the connection structures of the guide rails may be flexibly arranged.

FIG. 5 shows an intermediate state in the process of changing from the separated state in FIG. 4 to the final state. It is easy to understand that when different modules are assembled together, the guide rails in various modules are attached together by the connection structures, so that the ends of the guide rails are closely engaged in sequence, thereby forming connected guide rail assemblies that extend through all the modules.

The modular elevator assembly of the present application adopts a modular design, and the bottom module, the intermediate module, and the top module can be customized in the factory according to actual needs of the building, and the components of the modules can be pre-assembled or connected together. At the installation site of the building, the operators only need to hoist the modules in sequence from bottom to top and fit them together, and then connect the frames, guide rails and cables so that a desired modular elevator assembly can be obtained. For example, the corresponding number of intermediate modules can be selected according to the height of the floors, and then installation is performed in the order of the bottom module, the plurality of intermediate modules, and the top module. Such a solution avoids a lot of on-site operations and can reduce errors that may be caused by on-site welding and installation of large components.

The modular elevator assembly of the present application has the advantages of simplicity, easy for implementation, convenient in using, etc., and can realize rapid assembly of an elevator while providing good installation adaptability.

The present application has been disclosed herein with reference to the accompanying drawings, and those skilled in the art are also enabled to implement the present application, including manufacturing and using any device or system, selecting suitable materials, and using any combined method. The scope of the present application is defined by the claimed technical solutions, and contains other examples that can be conceived by those skilled in the art. Such other examples should be considered as falling within the scope of protection determined by the technical solutions claimed in the present application, as long as such other examples include structural elements that are not different from the literal language of the claimed technical solutions, or such other examples include equivalent structural elements that are not substantively different from the literal language of the claimed technical solutions.

What is claimed is:

1. A modular elevator assembly, comprising:

a bottom module;

a top module;

at least one intermediate module being configured to be removably stacked between the bottom module and the top module; and wherein each of the bottom module, the top module and the intermediate module comprises a plurality of guide rails, and the cross section of the guide rail comprises:

a first section extending along a length direction of the guide rail;

a second section extending in parallel to the first section and being attached to the first section; and a transition portion connecting between the first section and the second section and being configured to provide a cross-sectional profile that transits between the first section and the second section; and wherein the guide rail further comprises a connection structure, the connection structure is configured to connect the guide rails within adjacent modules in the modular elevator assembly together;

wherein the bottom module, the top module and the intermediate module respectively comprise a frame, the frame comprises a first side face, a second side face, a third side face and a fourth side face, and the guide rails are attached to the frame through connection members and are oriented such that the length direction is in the vertical direction, and wherein the guide rails and the frames have matching dimensions in the vertical direction;

wherein the frames of the bottom module, the top module and the intermediate module each includes a vertical structural member, the vertical structural members configured to be hollow, and a cables extends through the hollow vertical structural members and both ends of the cables are respectively provided with sockets.

2. The modular elevator assembly according to claim 1, wherein the connection structure comprises a protrusion or a recess formed at an end face in the length direction of the guide rail, and the protrusion and the recess are configured to match with each other in shape.

3. The modular elevator assembly according to claim 2, wherein the first protrusion and the first recess are disposed at the transition portions at the end faces of the guide rails, and the second protrusion and the second recess are disposed at the first sections or the second sections at the end faces of the guide rails.

4. The modular elevator assembly according to claim 3, wherein the guide rails comprises first guide rails for matching with an elevator car and second guide rails for matching with a counterweight.

5. The modular elevator assembly according to claim 1, wherein the protrusion comprises a conical first protrusion and a sawtooth-shaped second protrusion, and the recess comprises a conical first recess and a sawtooth-shaped second recess.

6. The modular elevator assembly according to claim 1, wherein the first guide rails are disposed at the second side face and the fourth side face, and the second side face and the fourth side face are positioned to face each other; the second guide rails are disposed at the third side face, and the third side face is positioned between the second side face and the fourth side face.

7. The modular elevator assembly according to claim 1, further comprising a landing door, the landing door is attached to the first side face of the frame.

8. The modular elevator assembly according to claim 7, wherein the position of the landing door relative to the frame is movable.

9. A modular elevator assembly, comprising:

a bottom module;

a top module;

at least one intermediate module being configured to be removably stacked between the bottom module and the top module; and wherein each of the bottom module, the top module and the intermediate module comprises a plurality of guide rails, and the cross section of the guide rail comprises:

a first section extending along a length direction of the guide rail;

a second section extending in parallel to the first section and being attached to the first section; and a transition portion connecting between the first section and the second section and being configured to provide a cross-sectional profile that transits between the first section and the second section; and wherein the guide rail further comprises a connection structure, the connection structure is configured to connect the guide rails within adjacent modules in the modular elevator assembly together;

wherein the bottom module, the top module and the intermediate module respectively comprise a frame, the frame comprises a first side face, a second side face, a third side face and a fourth side face, and the guide rails are attached to the frame through connection members and are oriented such that the length direction is in the vertical direction;

wherein a plurality of installation portions for fixing the frames into a hoistway are disposed on the peripheries of the frames of the top module and the intermediate module.

10. The modular elevator assembly according to claim 1, wherein the frames of various modules are connected by connection structures and bolts and are stacked together.

11. The modular elevator assembly according to claim 1, wherein the bottom of the bottom module is provided with a bottom panel, and the bottom module comprises one or more of the following components: a speed limiter, a tensioner, a compensation rope, a guide device, a lighting system, a power supply system, an intercom system, and a maintenance entrance.

12. The modular elevator assembly according to claim 11, wherein a plurality of plates are provided at the bottom of the bottom module, and the plates are disposed below the bottom panel.

13. The modular elevator assembly according to claim 1, wherein a top panel is provided at the top of the top module, and the top module comprises one or more of the following components: a tractor, a sling, and a motor.

14. The modular elevator assembly according to claim 1, wherein the bottom module, the top module and the intermediate module comprise a plurality of lifting rings respectively, and the lifting rings are arranged toward the top of each module.

* * * * *